US009057496B2

(12) United States Patent
Okubo

(10) Patent No.: US 9,057,496 B2
(45) Date of Patent: Jun. 16, 2015

(54) VEHICLE HEADLAMP

(75) Inventor: Yasuhiro Okubo, Isehara (JP)

(73) Assignee: ICHIKOH INDUSTRIES, LTD., Isehara-shi (JP)

( * ) Notice: Subject to any disclaimer, the term of this patent is extended or adjusted under 35 U.S.C. 154(b) by 303 days.

(21) Appl. No.: 13/599,300

(22) Filed: Aug. 30, 2012

(65) Prior Publication Data

US 2013/0051056 A1 Feb. 28, 2013

(30) Foreign Application Priority Data

Aug. 31, 2011 (JP) ..... 2011-189226

(51) Int. Cl.
*F21V 5/08* (2006.01)
*F21S 8/10* (2006.01)
*F21V 5/00* (2006.01)

(52) U.S. Cl.
CPC ..... *F21S 48/1154* (2013.01); *F21S 48/1208* (2013.01); *F21S 48/1266* (2013.01); *F21S 48/328* (2013.01)

(58) Field of Classification Search
CPC . F21S 48/1233; F21S 48/215; F21S 48/1154; F21S 48/2212; F21S 48/1159; F21S 48/1163; F21S 48/10; F21S 48/1283; F21S 48/125; F21S 48/2268; F21S 48/115; F21S 48/1225; F21S 48/1291; F21S 48/00–48/34; B60Q 1/04; B60Q 1/24; B60Q 2300/054
USPC ..... 362/520–522, 543–545
See application file for complete search history.

(56) References Cited

U.S. PATENT DOCUMENTS

| | | | | |
|---|---|---|---|---|
| 7,410,279 | B2 * | 8/2008 | Kawashima et al. | 362/507 |
| 2007/0047248 | A1 * | 3/2007 | Tsukamoto et al. | 362/520 |
| 2008/0094852 | A1 * | 4/2008 | King et al. | 362/516 |

FOREIGN PATENT DOCUMENTS

| | | | |
|---|---|---|---|
| EP | 2 202 454 | A2 | 6/2010 |
| EP | 2 351 963 | A1 | 8/2011 |
| JP | 2010-123447 | A | 6/2010 |
| JP | 2010-153076 | A | 7/2010 |

* cited by examiner

*Primary Examiner* — Karabi Guharay
*Assistant Examiner* — Nathaniel Lee
(74) *Attorney, Agent, or Firm* — Foley & Lardner LLP

(57) ABSTRACT

A vehicle headlamp that is capable of optically distributing a spot portion of a light distribution pattern having a cutoff line to a cruising lane side is provided. The present invention includes semiconductor-type light sources 2L and 2R and lenses 3L and 3R. On emission surfaces 31L and 31R of the lenses 3L and 3R, peak portions 32L and 32R that form a spot portion SP of a light distribution pattern for low beam LP are respectively provided in given locations that are close to a cruising lane side with respect to optical axes ZL and ZR of the lenses 3L and 3R. As a result, the present invention can provide the vehicle headlamp that is capable of optically distributing the spot portion SP of the light distribution pattern for low beam LP having a cutoff line CL.

6 Claims, 13 Drawing Sheets

VEHICLE HEADLAMP

CROSS REFERENCE TO RELATED APPLICATIONS

This application claims priority of Japanese Patent Application No. 2011-189226 filed on Aug. 31, 2011. The content of this application is incorporated herein by reference in their entirety.

BACKGROUND OF THE INVENTION

1. Field of the Invention

The present invention relates to a vehicle headlamp that employs a semiconductor-type light source as a light source to radiate a light distribution pattern having a cutoff line (a light distribution pattern for passing) forward of a vehicle.

2. Description of the Related Art

A vehicle headlamp that employ a semiconductor-type light source as light source is conventionally known (for example, Japanese Unexamined Patent Application Publication No. 2010-123447 and Japanese Unexamined Patent Application Publication No. 2010-153076). Hereinafter, these vehicle headlamps of the related art will be described. The former vehicle headlamp is provided with a light source and a lens that is adapted to employ light from the light source as a light distribution pattern having a cutoff line to polarize and emit the light to a front side. The latter vehicle headlamp is provided with a light emitting element and a light transmission member that is adapted to emit, from the front face, light from the light emitting element as a light distribution pattern having a cutoff line.

In such vehicle headlamps, it is important to optically distribute a spot portion (a high light intensity portion or a light focusing portion) of a light distribution pattern having a cutoff line to a cruising lane side from the viewpoint of improvement of visual recognition from a distal side.

The present invention has been made in view of the circumstance described above, and it is an object of the present invention to provide a vehicle headlamp that is capable of optically distributing a spot portion of a light distribution pattern having a cutoff line to a cruising lane side.

SUMMARY OF THE INVENTION

A vehicle headlamp according to first aspect of a present invention, comprising:

a semiconductor-type light source; and a lens adapted to forwardly radiate light from the semiconductor-type light source as a light distribution pattern having a cutoff line, wherein the lens is made of an incident surface in which the light from the semiconductor-type light source is incident into the lens and an emission surface from which the light that is incident into the lens is emitted, the incident surface of the lens is made of a composite quadrature curved surface, the emission surface of the lens is formed in a convex shape that gently protrudes to an opposite side to a side of the semiconductor-type light source, the emission surface being made of a free curved surface, and on the emission surface of the lens, a peak portion that forms a spot portion of the light distribution pattern is provided in a given location that is close to a cruising lane side with respect to an optical axis of the lens.

The vehicle headlamp according to second aspect of the present invention, wherein the incident surface of the lens is formed in a convex shape that gently protrudes to the semiconductor-type light source side.

The vehicle headlamp according to third aspect of the present invention, wherein on the emission surface of the lens, a gradient from the optical axis of the lens to an outside of a vehicle is gentler than a gradient from the optical axis of the lens to an inside of the vehicle.

The vehicle headlamp according to fourth aspect of the present invention, wherein in a shape of a planar view of the lens, a thickness from the optical axis of the lens to the outside of the vehicle is larger than a thickness from the optical axis of the lens to the inside of the vehicle.

The vehicle headlamp according to fifth aspect of the present invention, wherein a vehicle outside end part of the lens is formed in a shape going around a given region from a front side to a rear side.

The vehicle headlamp according to sixth aspect of the present invention, comprising:

an auxiliary semiconductor-type light source; and an auxiliary lens adapted to radiate light from the auxiliary semiconductor-type as an auxiliary light distribution pattern to the outside of the vehicle with respect to the light distribution pattern, wherein the auxiliary lens is provided at a vehicle outside end part of the lens.

The vehicle headlamp according to the first aspect of the present invention is provided in such a manner that a peak portion is provided in a given location that is close to a cruising lane side with respect to a lens optical axis of a lens emission surface, enabling a spot portion to be optically distributed on the cruising lane side from among the light distribution patterns. In this manner, visual recognition from a distal side on the cruising lane side is improved, making it possible to contribute to traffic safety.

The vehicle headlamp according to the second aspect of the present invention is provided in such a manner that a lens incident surface is formed in a convex shape that gently protrudes to the semiconductor-type light source side, thus facilitating optical design of a lens that is capable of optically distributing a spot portion to the cruising lane side from among the light distribution patterns, and further, enabling the spot portion to be easily and reliably optically distributed on the cruising lane side from among the light distribution patterns.

The vehicle headlamp according to the third aspect of the present invention is provided in such a manner that in a lens emission surface, a gradient from a lens optical axis to the outside of a vehicle (in other words, a degree of tilt from a front side to a rear side) is gentler than a gradient from the lens optical axis to the inside of the vehicle; and therefore, a thickness from the lens optical axis to the outside of the vehicle can be larger than a thickness from the lens optical axis to the inside of the vehicle. In this manner, both of the left and right end parts of the light distribution patterns can be increased in width to the outside of both of the left and right, and a light distribution pattern having an ideal cutoff line can be obtained.

Moreover, the vehicle headlamp according to the third aspect of the present invention is provided in such a manner that on the lens emission surface, the gradient from the lens optical axis to the outside of the vehicle is gentler than the gradient from the lens optical axis to the inside of the vehicle. As a result, when lenses of the vehicle headlamps that are mounted (equipped) on the front left and right of the vehicle are visually seen (viewed) from a front side of the vehicle, the lens emission surface in a single lens is transversely nonsymmetrical to the lens optical axis; and however, this lens emission surface is substantially transversely symmetrical to a center of the vehicle; and therefore, an appearance of an external view is improved without feeling any unnatural sense of the external view, The vehicle headlamp according to the fourth aspect of the present invention is provided in such a manner that the shape of planer viewing of a lens can be formed in a shape in which a thickness from a lens optical axis to the outside of a vehicle is larger than a thickness from the lens optical axis to the inside of the vehicle; and therefore, as is the case with the vehicle headlamp according to the second aspect of the present invention, both of the left and right end parts of a light distribution pattern can be increased in width to the outside of both of the left and right, and a light distribution pattern having an ideal cutoff line can be obtained.

The vehicle headlamp according to the fifth aspect of the present invention is provided in such a manner that a vehicle outside end part of the lens is formed in a shape going around a given region from a front side to a rear side, whereby both of the left and right end parts of a light distribution pattern can be increased in width to the outside of both of the left and right, and a light distribution pattern having an ideal cutoff line can be obtained. Furthermore, when the lenses of the left and right vehicle headlamps that are mounted on a vehicle is visually seen from a front side of the vehicle, the lenses are transversely symmetrical to the center of the vehicle; and therefore, an appearance of an external view is further improved without feeling a further unnatural sense of the external view.

DESCRIPTION OF THE PREFERRED EMBODIMENTS

Hereinafter, three examples of the preferred embodiments (the exemplary embodiments) of vehicle headlamps according to the present invention will be described in detail with reference to the drawings. It is to be noted that the present invention is not limited by the embodiments. In the present specification, the terms "front", "rear", "top", "bottom", "left", and "right" respectively designate the front, rear, top, bottom, left, and right that are defined when the vehicle headlamp according to the present invention is mounted on a vehicle. In addition, a combination of uppercase letters with hyphen "VU-VD" designates a vertical line from the top to bottom of a screen, and a combination of uppercase letters with hyphen "HL-HR" designates a horizontal line from the left to right of the screen.

(Description of Configuration of First Embodiment)

Figure 1:
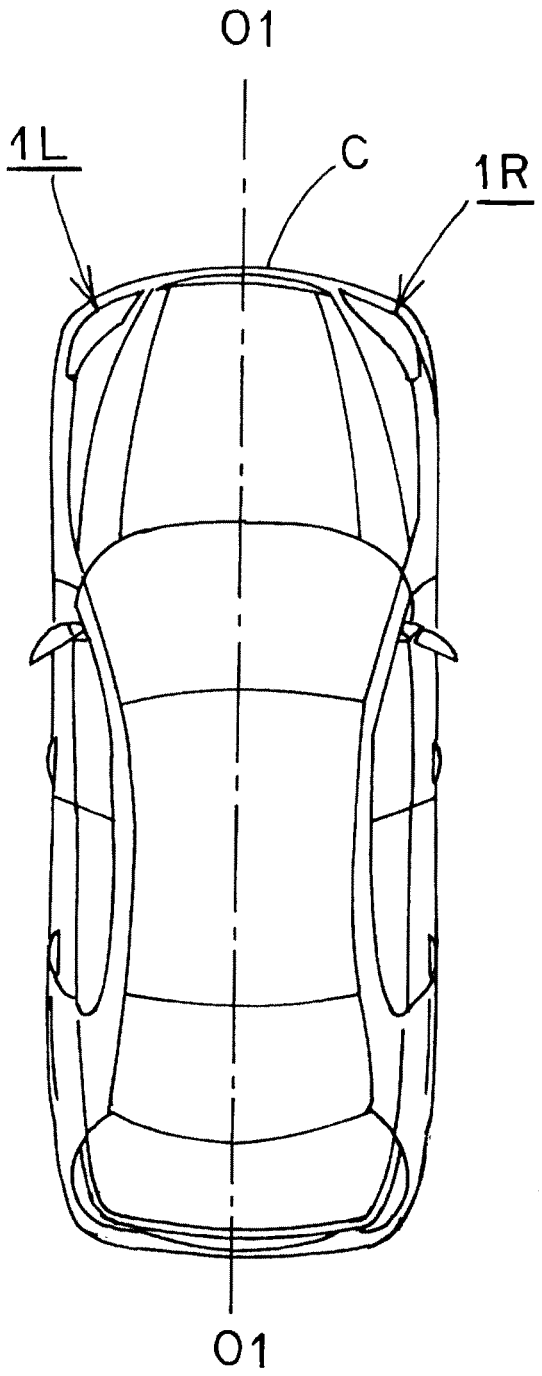
FIG. 1 shows a vehicle headlamp according to a first embodiment of the present invention, and is a plan view of a vehicle mounting both of the left and right vehicle headlamps thereon.
Figure 2:
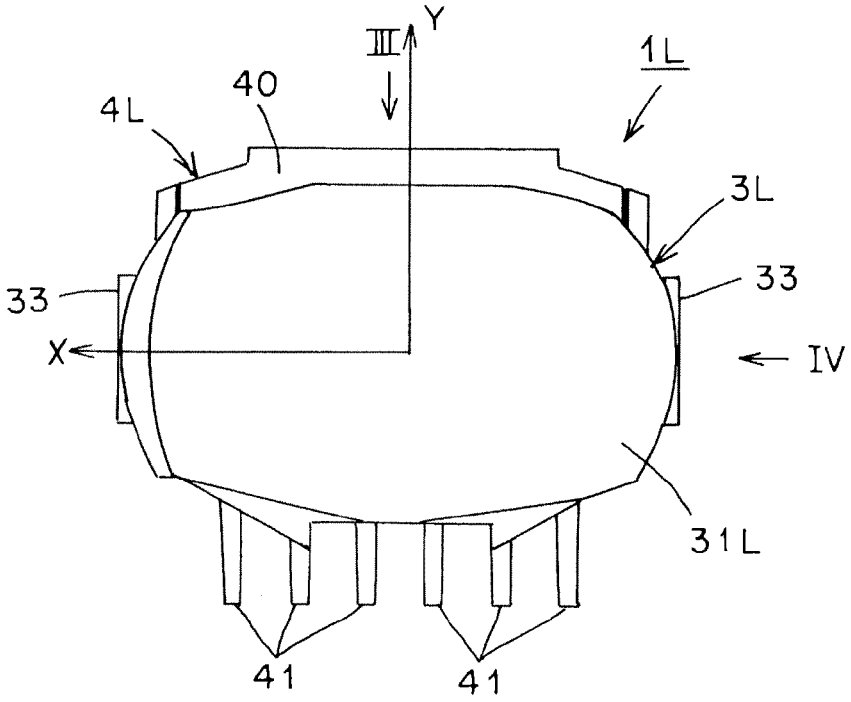
FIG. 2 is a front view showing a left side lamp unit.
Figure 3:
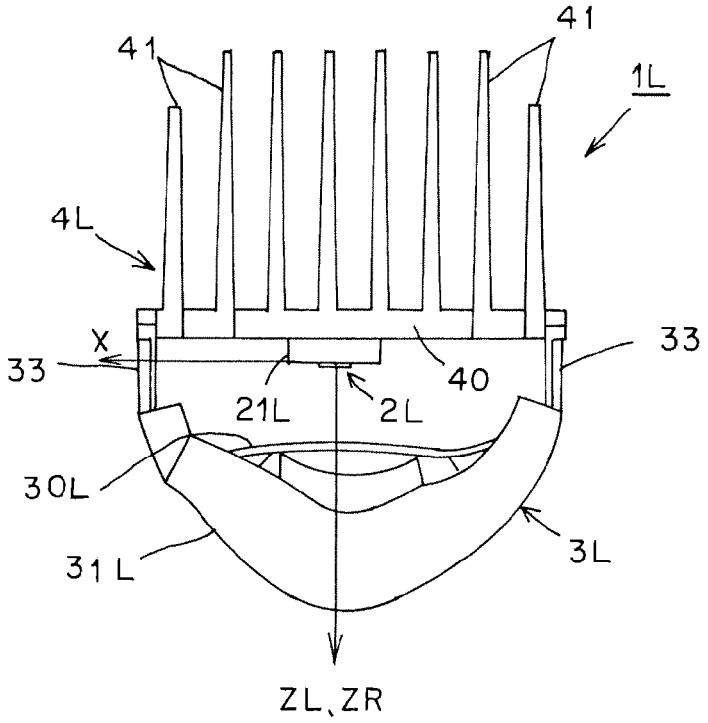
FIG. 3 is a plan view showing the left side lamp unit (a view taken along the arrow III in FIG. 2)
Figure 4:
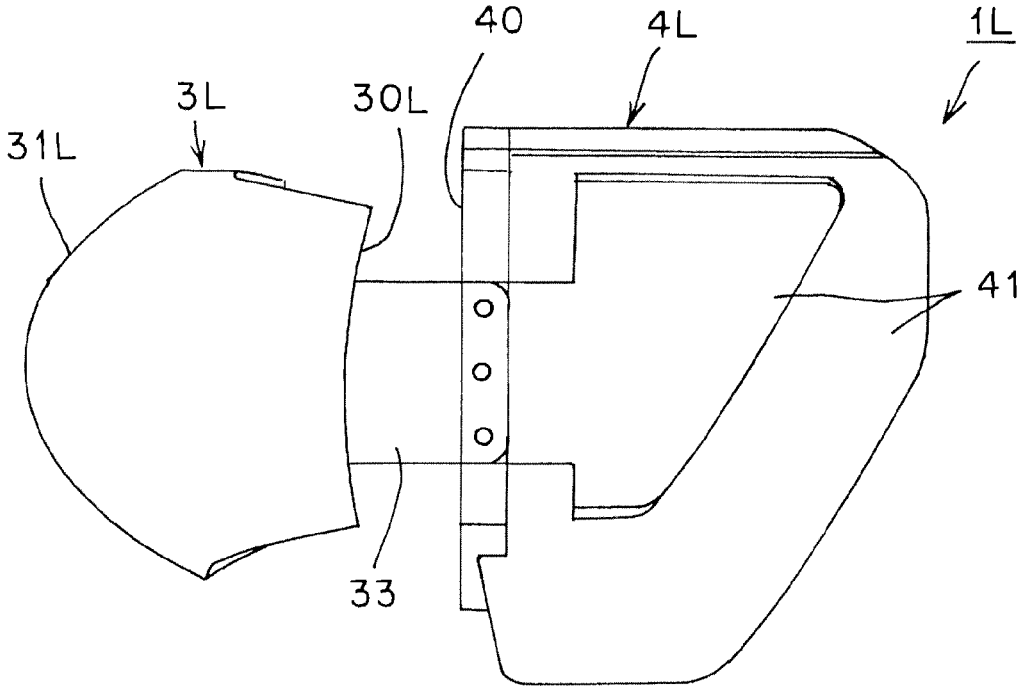
FIG. 4 is a right side view showing the left side lamp unit (a view taken along the arrow IV in FIG. 2)
Figure 5:
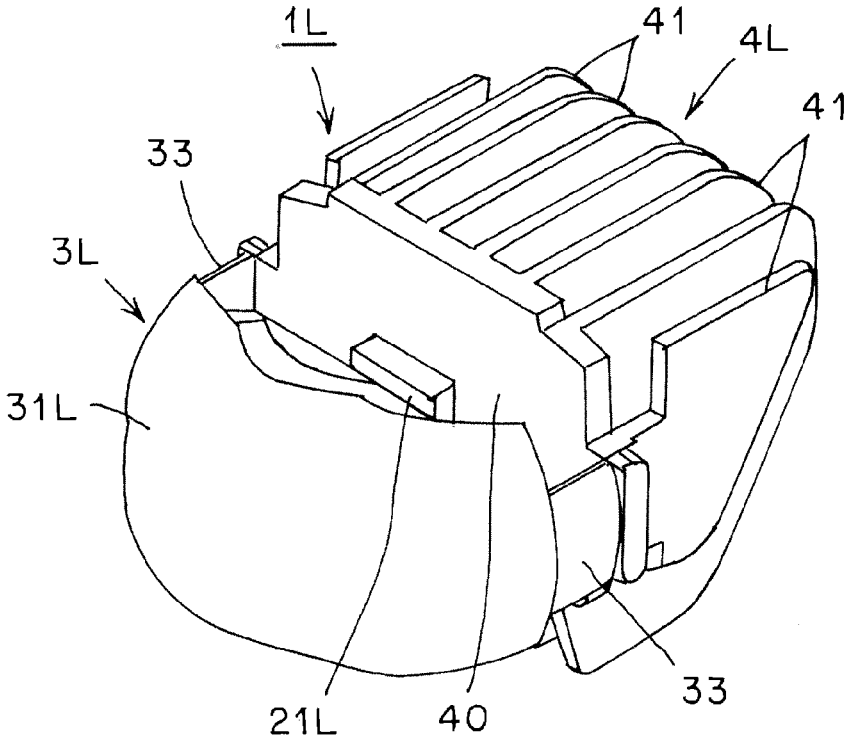
FIG. 5 is a perspective view showing the left side lamp unit.

FIG. 1 to FIG. 9 shows vehicle headlamps according to a first embodiment of the present invention. Hereinafter, a configuration of the vehicle headlamps in the first embodiment will be described. In FIG. 1, reference numerals 1L and 1R respectively designate vehicle headlamps (such as headlamps, for example) in the exemplary embodiment. The vehicle headlamps 1L and 1R are respectively mounted on both of the front left and right end parts of a vehicle C.

The vehicle headlamps 1L and 1R, as shown in FIG. 2 to FIG. 5, are provided with: a lamp housing (not shown); lamp lenses (not shown); semiconductor-type light sources 2L and 2R; lenses 3L and 3R; and a heat sink member 4L. It is to be noted that a heat sink member of the right side vehicle headlamp 1R is not shown because its structure is substantially identical to that of the heat sink member 4L of the left side vehicle headlamp 1L.

The semiconductor-type light source 2L and 2R, the lenses 3L and 3R and the heat sink 4L configure a lamp unit. The lamp housing and the lamp lens define a lamp room (not shown). The constituent elements 2L, 2R, 3L, 3R, and 4L of the above lamp unit are disposed in the lamp room, and are mounted on the lamp housing via an optical axis adjustment mechanism for vertical direction (not shown) and an optical axis adjustment mechanism for transverse direction (not shown).

The semiconductor-type light sources 2L and 2R, in this example, use a self-light semiconductor-type light source such as an LED or an EL (an organic EL), for example, and in other words, these light sources use a semiconductor-type light source (an LED in this exemplary embodiment). The semiconductor-type light sources 2L and 2R each are made of: a board (not shown); a light emitting chip 20 that is provided on the board; and a sealing resin member (not shown) that is adapted to seal the light emitting chip 20. The semiconductor-type light sources 2L and 2R are mounted on the heat sink 4L by means of mount members 21L and 21R, respectively. The light emitting chips 20 of the semiconductor-type light source 2L and 2R emit light beams when a current is supplied to the light emitting chip via the mount members 21L and 21R and the board.

Figure 6:
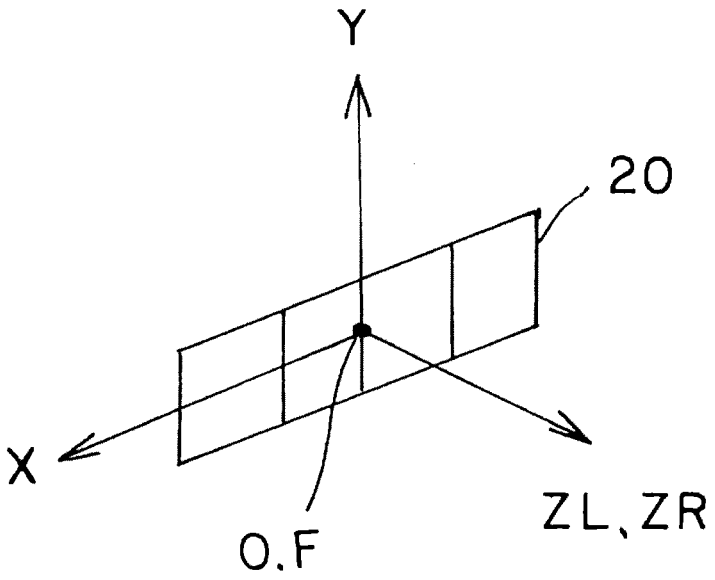
FIG. 6 is an explanatory perspective view showing a light-emitting chips of a semiconductor-type light source.

The light emitting chip 20, as shown in FIG. 6, is formed in a planer rectangular shape (a planer rectangle shape). In other words, four square chips are arranged in an X-axis direction (a horizontal direction). It is to be noted that one rectangle ship or one square chip may be used. The center O of the light emitting chip 20 is positioned at or near a reference focal point F of the lenses 3L and 3R and on or near reference optical axes (reference axes) ZL and ZR of the lenses 3L and 3R. The light emission surface of the light emitting chip 20 is oriented to the front side of the reference optical axes ZL and ZR of the lenses 3L and 3R.

In FIG. 6, the X, Y, ZL, and ZR axes configure an orthogonal coordinate (an X-Y-Z orthogonal coordinate system). The X axis corresponds to a horizontal axis in a transverse direction passing through the center O of the light emitting chip 20, and this axis is on a cruising lane side, and in other words, in the embodiment, the right side is in a positive direction, and the left side is a negative direction. In addition, the Y axis corresponds to a vertical axis in a vertical direction passing through the center O of the light emitting chip 20, and in the embodiment, the upper side is in a positive direction, and the lower side is a negative direction. Further, the Z axis corresponds to a normal line (a perpendicular line) passing through the center O of the light emitting chip 20, and in other words, this Z axis corresponds to an axis in a forward/backward direction orthogonal to the X axis and the Y axis, and in the embodiment, the front side is in a positive direction, and the rear side is in a negative direction.

Figure 7:
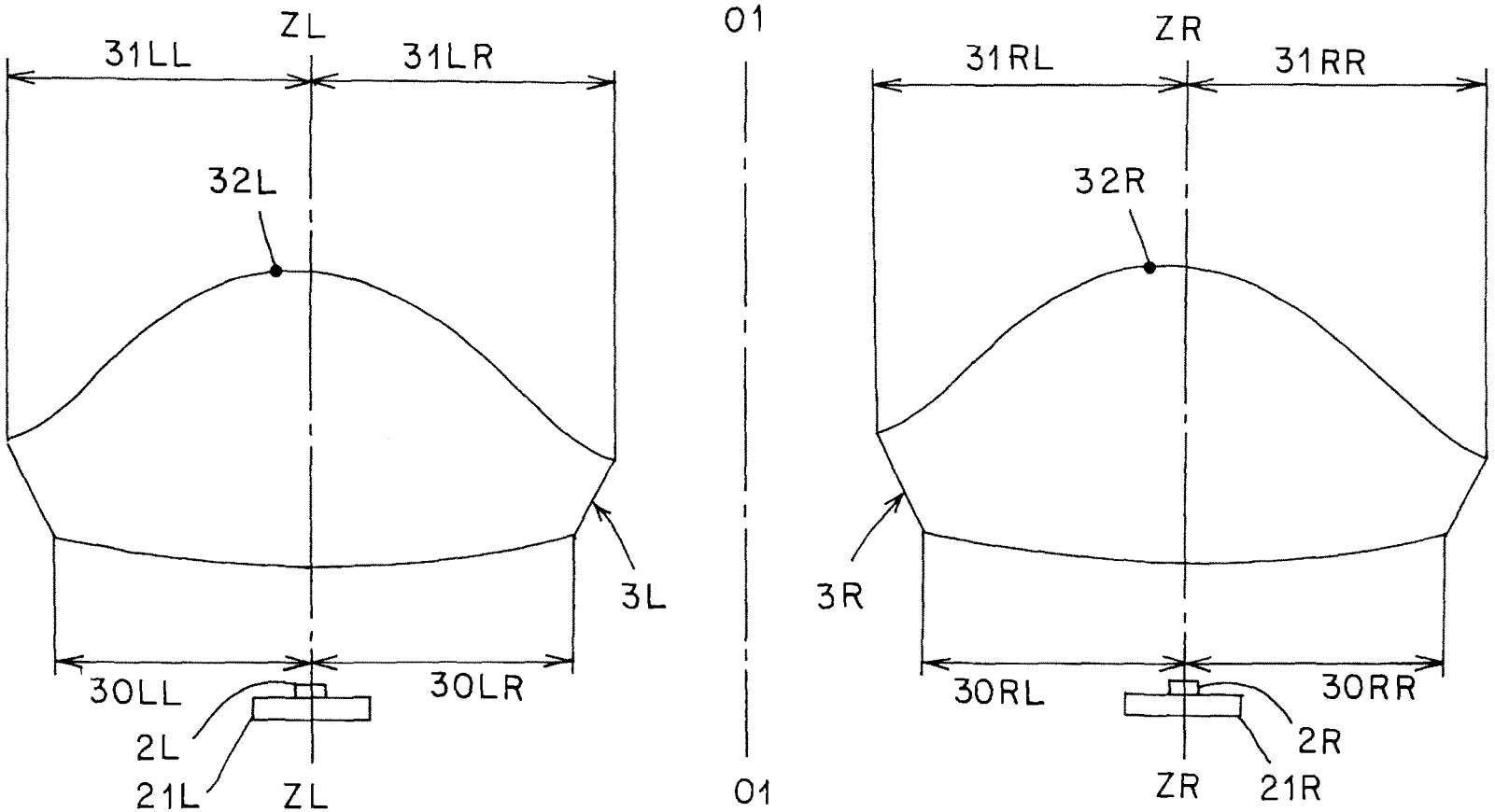
FIG. 7 is an explanatory perspective view showing a respective one of left and right side lenses.
Figure 8:
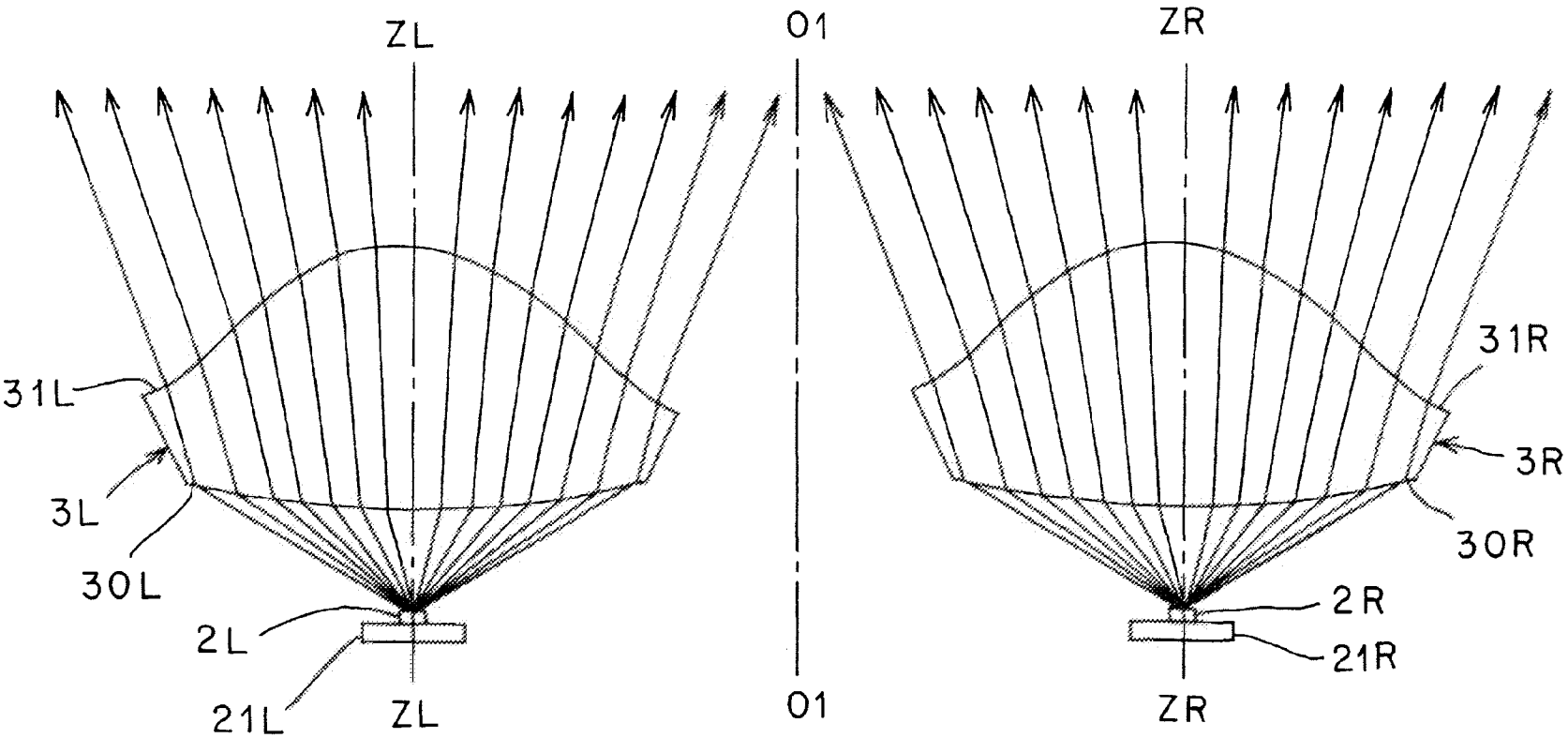
FIG. 8 is an explanatory perspective view showing an optical path of a respective one of the left and right side lenses.

The lenses 3L and 3R, as shown in FIG. 7 and FIG. 8, comprise respectively made of incident surfaces 30L and 30R in which the light beams from the semiconductor-type light sources 2L and 2R are incident into the lenses 3L and 3R; and emission surfaces 31L and 31R from which the light beams incident into the lenses 3L and 3R are emitted.

The incident surfaces 30L and 30R of the lenses 3L and 3R are respectively formed in a convex shape that gently protrudes to the side of the semiconductor-type light sources 2L and 2R, and a respective one of the incident surfaces is made of a composite quadrature curved surface (in the embodiment, the composite quadrature curved surface that is transversely symmetrical to a respective one of the optical axes ZL and ZR of the lenses 3L and 3R). It is to be noted that the composite quadrature curved surface is a combination of quadrature curved surfaces such as curves such as an ellipse, a circle, a parabola, and a hyperbola or a plane.

The emission surfaces 31L and 31R of the lenses 3L and 3R are respectively formed in a convex shape that gently protrudes to an opposite side to that of a respective one of the semiconductor-type light sources 2L and 2R, and a respective one of the emission surfaces is made of a free curved surface. On the emission surfaces 31L and 31R of the lenses 3L and 3R, peak portions 32L and 32R that form a spot portion SP of a light distribution pattern having a cutoff line CL shown in FIG. 9 (C), in the embodiment, the peak portions being those of a light distribution pattern for low beam (a light distribution pattern for passing) LP, are respectively provided on the cruising lane side with respect to the optical axes ZL and ZR of the lenses 3L and 3R, and in the embodiment, the peak portions each are provided in a given location that is close to the left side.

The peak portions 32L and 32R are respectively obtained as peak portions formed in a shape (refer to FIG. 7) of a planer view of the emission surfaces 31L and 31R of the lenses 3L and 3R (when visually seen from an upper side). A thickness in the forward/backward direction of the lenses 3L and 3R in the peak portions 32L and 32R becomes maximal.

Herein, left side portions 30LL and 30RL and right side portions 30LR and 30RR of the incident surfaces 30L and 30R of the lenses 3L and 3R are substantially transversely symmetrical to the optical axes ZL and ZR of the lenses 3L and 3R, respectively. Left side portions 31LL and 31RL and right side portions 31LR and 31RR of the emission surfaces 31L and 31R of the lenses 3L and 3R are transversely non-symmetrical to the optical axes ZL and ZR of the lenses 3L and 3R, respectively.

The heat sink member 4L is made of: a perpendicular plate portion 40; and a fin portion 41 that is formed in the shape of a plurality of perpendicular plates, the fin portion being integrally provided on one face (a rear side face) of the perpendicular plate portion 40. On the other face (a front side face) of the perpendicular plate portion 40 of the heat sink member 4L, the semiconductor-type light sources 2L and 2R are respectively mounted via the mount members 21L and 21R. On both of the side edges of the perpendicular plate portion 40 of the heat sink member 4L, the lenses 3L and 3R are mounted via a holder 33. The holder 33 may be integrated with the lenses 3L and 3R, or alternatively, this holder may be separated from these lenses.

(Description of Functions of First Embodiment)

The vehicle headlamps 1L and 1R in the first embodiment are respectively made of the constituent elements as described above, and hereinafter, related functions thereof will be described.

The light emitting chips 20 of the semiconductor-type light sources 2L and 2R are lit. Then, as indicated by the arrow drawn by the solid line in FIG. 8, the light beams from the light emitting chips 20 are respectively incident into the lenses 3L and 3R from the incident surfaces 30L and 30R of the lenses 3L and 3R. At this time, the incident light beams are controlled to be optically distributed in the incident surfaces 30L and 30R, respectively. The incident light beams that are incident into the lenses 3L and 3R are respectively emitted from the emission surfaces 31L and 31R of the lenses 3L and 3R. At this time, the emitted light beams are respectively controlled to be optically distributed in the emission surfaces 31L and 31R.

Figure 9:
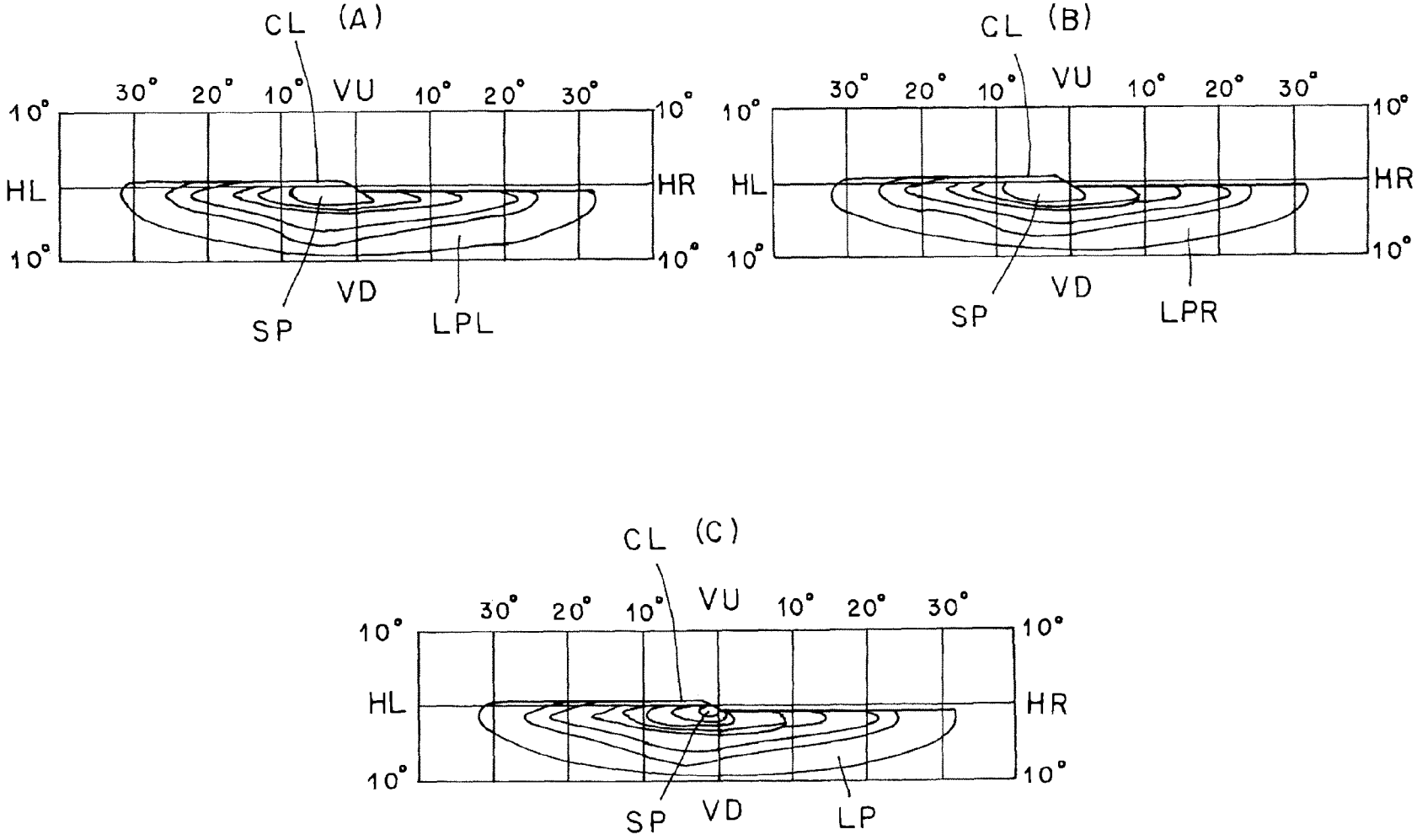
FIG. 9 is an explanatory view showing a light distribution pattern for low beam of a left side vehicle headlamp, a light distribution pattern for low beam of a right side vehicle headlamp, and a light distribution pattern for low beam having been obtained by overlapping both of the left and right vehicle headlamps.

The emitted light from the left side lens 3L, as shown in FIG. 9 (A), is radiated forward of the vehicle C as a left side light distribution pattern for low beam LPL which has a cutoff line CL, and which has a spot portion SP on a left side of a cruising lane side, and further, which is substantially equal in spreading of both of the left and right end parts.

The emitted light from the right side lens 3R, as shown in FIG. 9 (B), is radiated forward of the vehicle C as a right side light distribution pattern for low beam LPR which has a cutoff line CL, and which has a spot portion SP on the left side of the cruising lane side, and further, which is substantially equal in spreading of both of the left and right end parts.

The left side light distribution pattern for low beam LPL and the right side light distribution pattern for low beam LPR are overlapped on each other, and as shown in FIG. 9 (C), a light distribution pattern for low beam LP is formed which has a cutoff line CL, and which has a spot portion SP on the left side of the cruising lane side, and further, which is substantially equal in spreading of both of the left and right end parts.

(Description of Advantageous Effect of First Embodiment)

The vehicle headlamps 1L and 1R in the first embodiment are respectively made of the constituent elements and functions as described above, and hereinafter, related advantageous effects thereof will be described.

The vehicle headlamps 1L and 1R according to the first embodiment are provided in such a manner that peak portions 32L and 32R are respectively provided in given locations that are close to a cruising lane side with respect to lens optical axes ZL and ZR of lenses 3L and 3R of the lens emission surfaces 31L and 31R of the lenses 3L and 3R, enabling a spot portion SP to be optically distributed on the cruising lane side from among the light distribution patterns LP. In this manner, visual recognition from a distal side on the cruising lane side is improved, making it possible to contribute to traffic safety.

The vehicle headlamps 1L and 1R according to the first embodiment are respectively provided in such a manner that lens incident surfaces 30L and 30R of the lenses 3L and 3R are respectively formed in a convex shape that gently protrudes to the side of the semiconductor-type light sources 2L and 2R, thus facilitating optical design of lenses 3L and 3R that are capable of optically distributing a spot portion SP to the cruising lane side from among the light distribution patterns LP, and further, enabling the spot portion SP to be easily and reliably optically distributed on the cruising lane side from among the light distribution patterns LP.

(Description of Second Embodiment)

Figure 10:
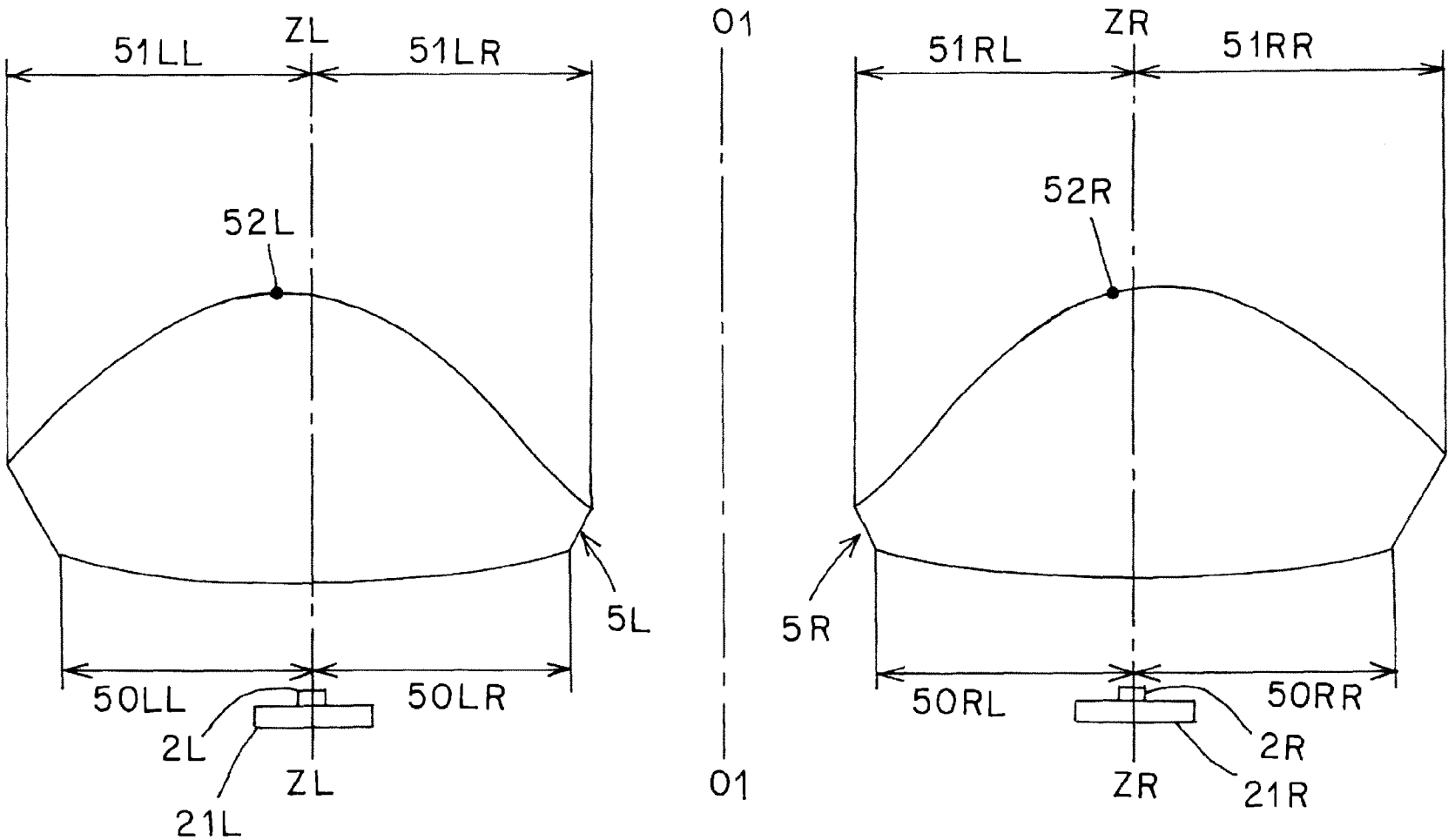
FIG. 10 is an explanatory plan view showing a respective one of the left and right lenses showing a vehicle headlamp according to a second embodiment of the present invention.
Figure 11:
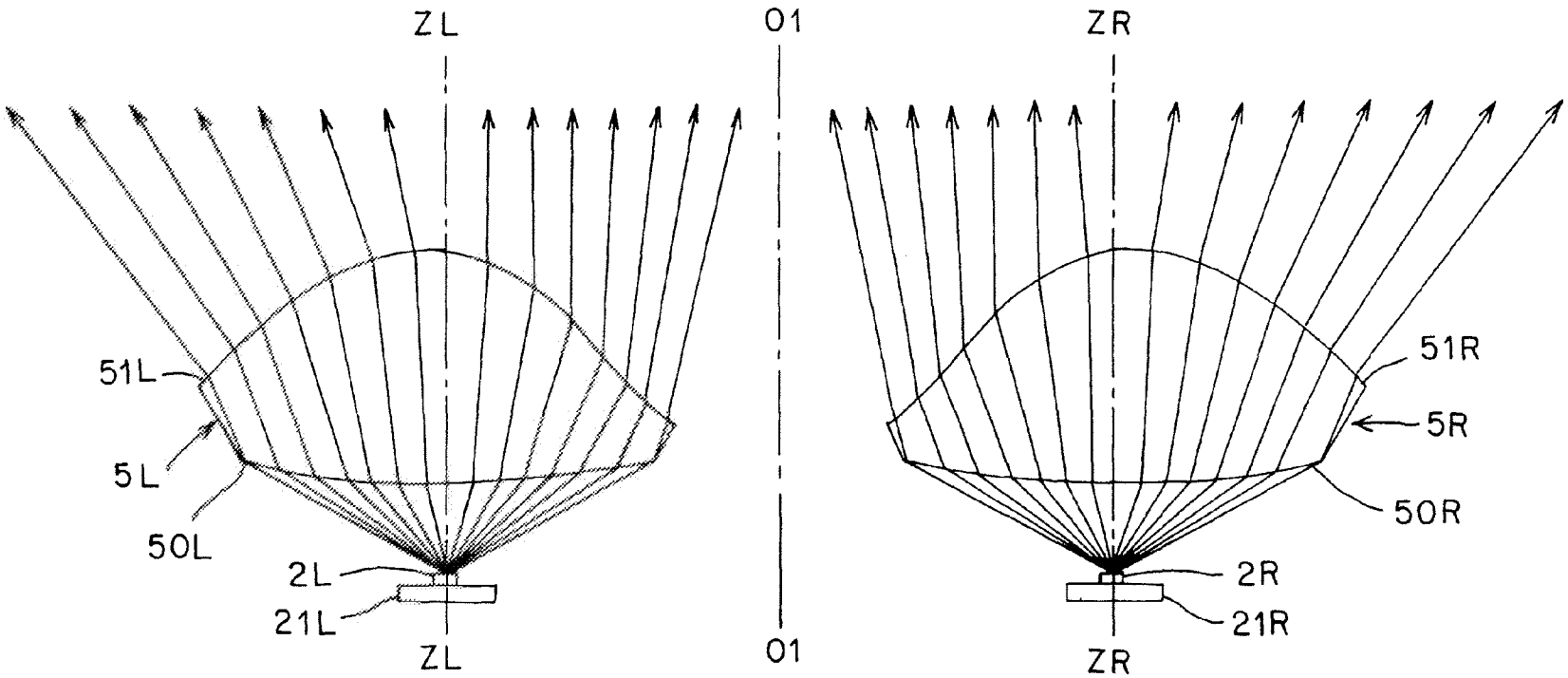
FIG. 11 is an explanatory plan view showing an optical path of a respective one of the left and right side lens.
Figure 12:
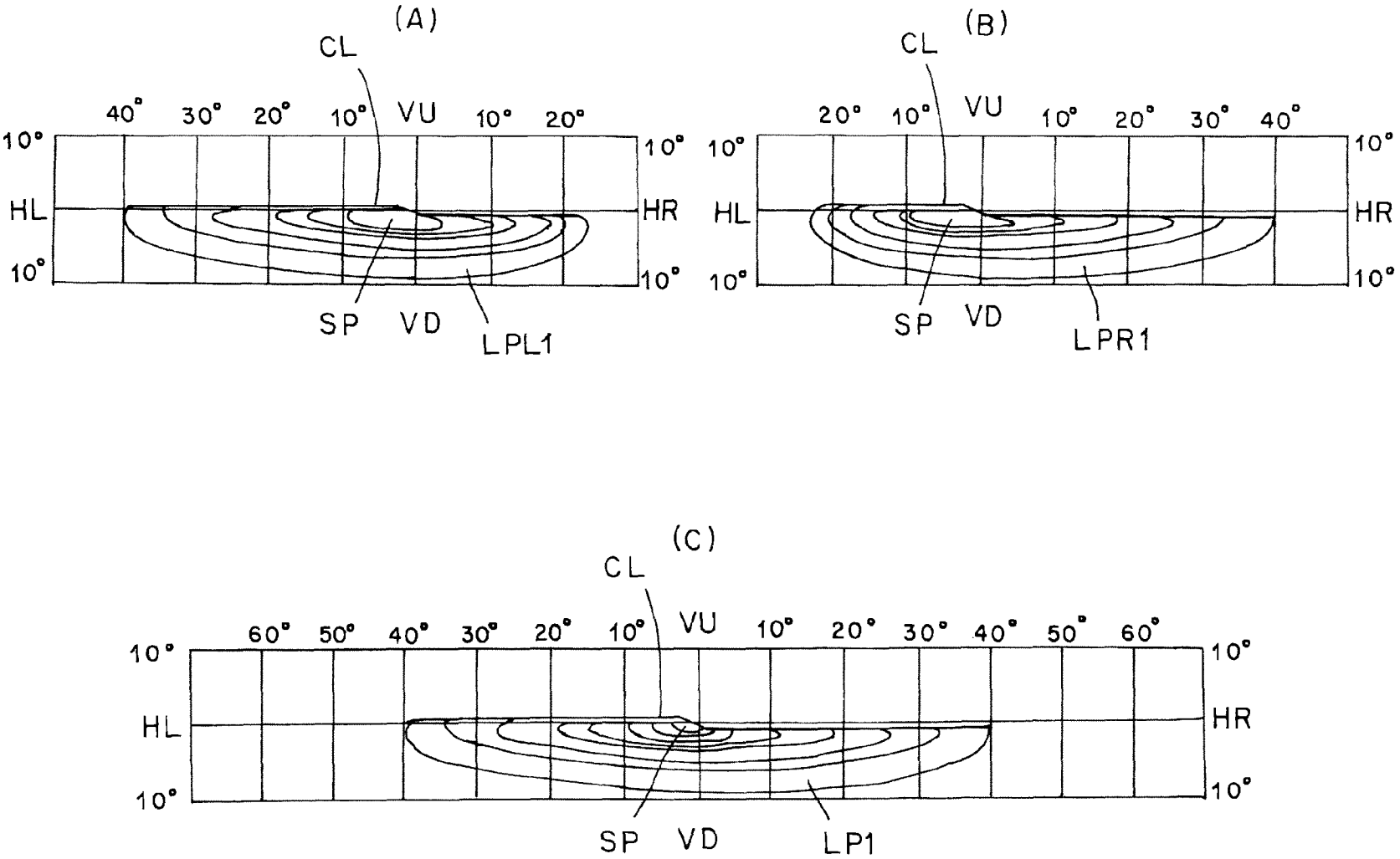
FIG. 12 is an explanatory view showing a light distribution pattern for low beam of a left side vehicle headlamp, a light distribution pattern for low beam of a right side vehicle headlamp, and a light distribution pattern for low beam having been obtained by overlapping both of the left and right vehicle headlamps.

FIG. 10 to FIG. 12 shows a vehicle headlamps according to a second embodiment of the present invention. Hereinafter, the vehicle headlamps in the second embodiment will be described. In the figures, like constituent elements shown in FIG. 1 to FIG. 9 are designated by like reference numerals.

Lenses 5L and 5R of the vehicle headlamps in the second embodiment, as shown in FIG. 10 and FIG. 11, comprises: incident surfaces 50L and 50R in which light beams from the semiconductor-type light sources 2L and 2R (refer to the arrow drawn by the solid line in FIG. 11) are respectively incident into the lenses 5L and 5R; and emission surfaces 51L and 51R from which the light beams that are incident into the lenses 5L and 5R are emitted, respectively.

The incident surfaces 50L and 50R of the lenses 5L and 5R are respectively formed in a convex shape that gently protrudes to the side of the semiconductor-type light sources 2L and 2R, and these incident surfaces each are formed of a composite quadrature curved surface (in the embodiment, the composite quadrature curved surface that is transversely symmetrical to a respective one of the optical axes ZL and ZR of the lenses 5L and 5R). It is to be noted that the composite quadrature curved surface is obtained as a combination of curves such as an ellipse, a circle, a parabola, and a hyperbola, for example, or a plane.

The emission surfaces 51L and 51R of the lenses 5L and 5R are respectively formed in a convex shape that gently protrudes to an opposite side to that of a respective one of the semiconductor-type light sources 2L and 2R, and these emission surfaces each are formed of a free curved surface. On the emission surfaces 51L and 51R of the lenses 5L and 5R, peak portions 52L and 52R that form a spot portion SP of a light distribution pattern having a cutoff line CL shown in FIG. 12 (A), FIG. 12 (B), and FIG. 12 (C), in the embodiment, the peak portions being those of light distribution patterns for low beam (light distribution patterns for passing) LP1, LPL1, and LPR1, are respectively provided on the cruising lane side with respect to the optical axes ZL and ZR of the lenses 5L and 5R, and in the embodiment, these peak portions each are provided in a given location that is close to the left side.

The peak portions 52L and 52R are respectively obtained as peak portions in a shape (refer to FIG. 10) of a planar view of the emission surfaces 51L and 51R of the lenses 5L and 5R (which is visually seen from an upper side). A thickness (a length) in the forward/backward direction of a respective one of the lenses 5L and 5R in the peak portions 52L and 52R becomes maximal.

Herein, left side portions 50LL and 50RL and right side portions 50LR and 50RR of the incident surfaces 50L and 50R of the lenses 5L and 5R are substantially transversely symmetrical to the optical axes ZL and ZR of the lenses 5L and 5R, respectively. Left side portions 51LL and 51RL and right side portions 51LR and 51RR of the emission surfaces 51L and 51R of the lenses 5L and 5R are transversely non-symmetrical to the optical axes ZL and ZR of the lenses 5L and 5R, respectively.

In the emission surfaces 51L and 51R of the lenses 5L and 5R, a gradient to the outside from the optical axes ZL and ZR of the lenses 5L and 5R (in other words, a degree of a tilt from a front side to a rear side of a left side portion 51LL of the emission surface 51L of the left side lens 5L and a degree of a tilt from a front side to a rear side of a right side portion 51RR of the emission surface 51R of the right side lens 5R) is gentler than a gradient to the inside from the optical axes ZL and ZR of the lenses 5L and 5R (in other words, a degree of a tilt from a front side to a rear side of a right side portion 51LR of the emission surface 51L of the left side lens 5L and a degree of a tilt from a front side to a rear side of a left side portion 51RL of the emission surface 51R of the right side lens 5R).

In other words, in the shape of the planer view of the lenses 5L and 5R (which is visually seen from an upper side), a thickness of the outside of a vehicle from the optical axes ZL and ZR of the lenses 5L and 5R (in other words, a thickness (a length) in the forward/backward direction from the left side portion 50LL of the incident surface SOL of the left side lens 5L to the left side portion 51LL of the emission surface 51L) and a thickness (a length) in the forward/backward direction from the right side portion 51RR of the incident surface 50R of the lens 5R to the right side portion 51RR of the right side lens 5R) are larger than a thickness of the inside of the vehicle from optical axes ZL and ZR of the lenses 5L and 5R (in other words, a thickness (a length) in the forward/backward direction from the right side portion 50LR of the incident surface 50L of the left side lens 5L to the right side portion 51LR of the emission surface 51L and a thickness (a length) in the forward/backward direction from the left side portion 50RL of the incident surface 50R of the right side lens 5R to the left side portion 51RL of the emission surface 51R.

The vehicle headlamps in the second embodiment are configured as described above, thus making it possible to achieve functions and advantageous effects that are substantially similar to those of the vehicle headlamps 1L and 1R in the first embodiment described previously.

In particular, according to the vehicle headlamps in the second embodiment, in the emission surfaces 51L and 51R of the lenses 5L and 5R, a gradient from the optical axes ZL and ZR of the lenses 5L and 5R to the outside of the vehicle (in other words, a degree of a tilt from a front side to a rear side) is gentler than a gradient from the optical axes ZL and ZR of the lenses 5L and 5R to the inside of the vehicle (in other words, a degree of a tilt from a front side to a rear side). Thus, according to the vehicle headlamps in the second embodiment, the shape in a planer view of the lenses 5L and 5R can be formed in a shape in which a thickness from the optical axes ZL and ZR of the lenses 5L and 5R to the outside of the vehicle is larger than a thickness from the optical axes ZL and ZR of the lenses 5L and 5R to the inside of the vehicle. In this manner, according to the vehicle headlamps in the second embodiment, as shown in FIG. 12 (A), FIG. 12 (B), and FIG. 12 (C), both of the left and right end parts of a light distribution pattern can be increased in width to the outside of both of the left and right, and light distribution patterns for low beams LP1, LPL1, and LPR1, at least one of which has an ideal cutoff line, can be obtained.

Moreover, according to the vehicle headlamps in the second embodiment, in the emission surfaces 51L and 51R of the lenses 5L and 5R, the gradient from the optical axes ZL and ZR of the lenses 5L and 5R to the outside of the vehicle is gentler than a gradient from the optical axes ZL and ZR of the lenses 5L and 5R to the inside of the vehicle. As a result, according to the vehicle headlamps in the second embodiment, when the lenses 5L and 5R of the vehicle headlamps that are mounted on the front left and right of the vehicle are visually seen (viewed) from a front side of the vehicle, the emission surfaces 51L and 51R of the lenses 5L and 5R in the single lenses 5L and 5R are transversely nonsymmetrical to the optical axes ZL and ZR of the lenses 5L and 5R, respectively; and however, these emission surfaces each are substantially transversely symmetrical to the center of the vehicle (refer to reference numeral "O1-O1" in FIG. 1); and therefore, an appearance of an external view is improved without feeling an unnatural sense of the external view.

(Description of Third Embodiment)

Figure 13:
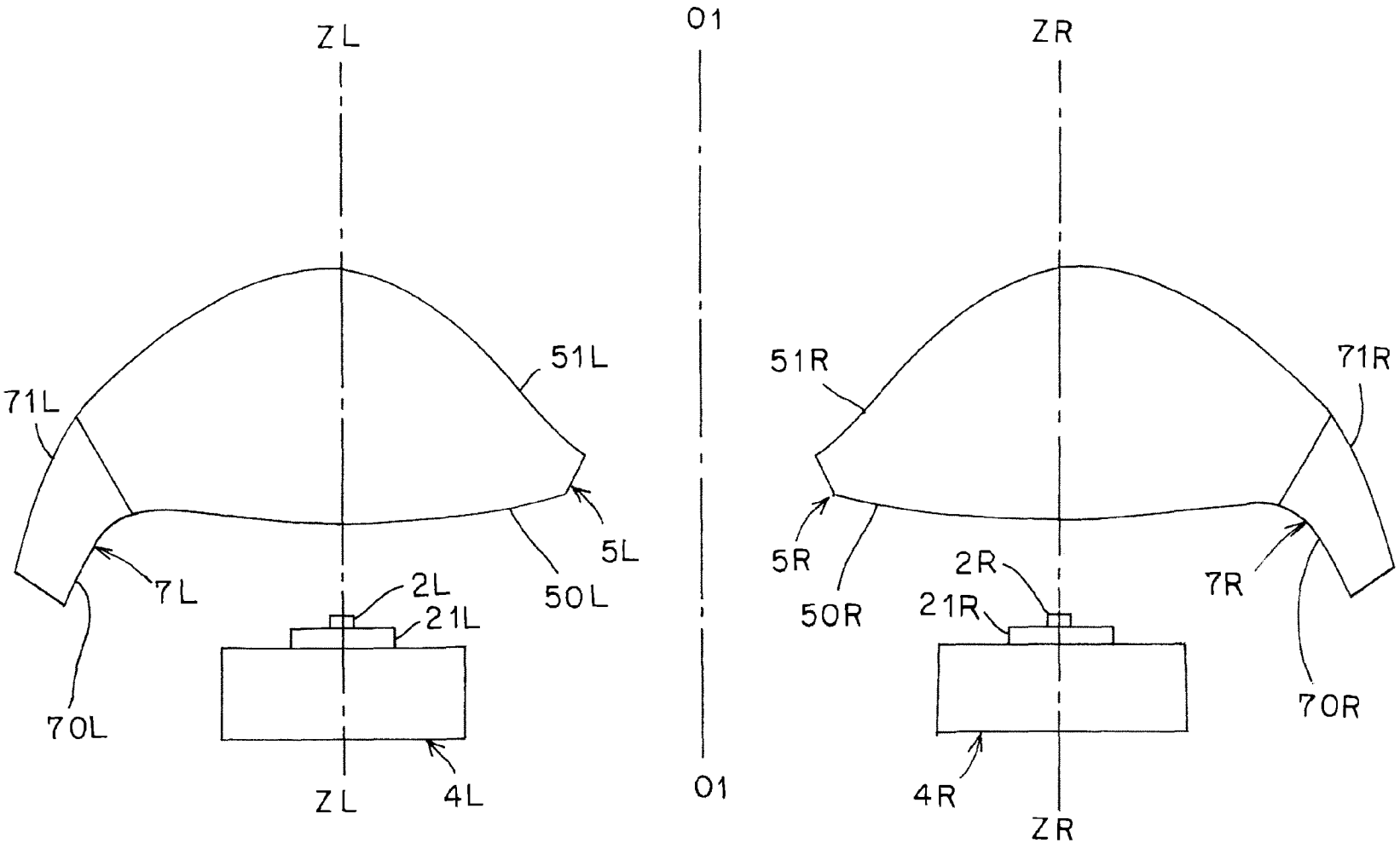
FIG. 13 is an explanatory plan view showing a respective one of the left and right lenses showing a vehicle headlamp according to a third embodiment of the present invention.

FIG. 13 shows vehicle headlamps according to a third embodiment of the present invention. Hereinafter, the vehicle headlamps in the third embodiment will be described. In the figure, like constituent elements shown in FIG. 1 to FIG. 12 are designated by like reference numerals.

The vehicle headlamps in the third embodiment are respectively provided with auxiliary lenses 7L and 7R. The auxiliary lenses 7L and 7R are respectively provided at their appropriate end parts outside of a vehicle of the lenses 5L and 5R of the vehicle headlamps in the second embodiment described previously. The auxiliary lenses 7L and 7R that are respectively provided at the vehicle outside end parts of the lenses 5L and 5R of the vehicle headlamps in the second embodiment described previously are formed in a shape going around a region from a front side to a rear side. In other words, the auxiliary lenses 7L and 7R are respectively provided in the shape going around the given region from the front side to the rear side from the vehicle outside end parts of the lenses 5L and 5R of the vehicle headlamps in the second embodiment described previously.

Incident surfaces 70L and 70R of the auxiliary lenses 7L and 7R are respectively formed in a shape going around a region from the front side to the rear side so as to be continuous from the vehicle outside end parts of the incident surfaces 50L and 50R of the lenses 5L and 5R of the vehicle headlamps in the second embodiment described previously. The incident surfaces 70L and 70R of the auxiliary lenses 7L and 7R each have a turning point which may cause a change in a curvature direction of a respective one of the incident surfaces 50L and 50R of the lenses 5L and 5R of the vehicle headlamps in the second embodiment described previously. In other words, the incident surfaces 50L, 50R, 70L, and 70R of the lenses 5L, 5R, 7L, and 7R each are formed in an S shape. The emission surfaces 71L and 71R of the auxiliary lenses 7L and 7R respectively faithfully follow the shape formed by the incident surfaces 70L and 70R going around the given region, and these emission surfaces are respectively formed in the shape going around the given region from the front side to the rear side so as to be continuous from the end parts outside of the emission surfaces 51L and 51R of the lenses 5L and 5R of the vehicle headlamps in the second embodiment described previously.

Figure 15:
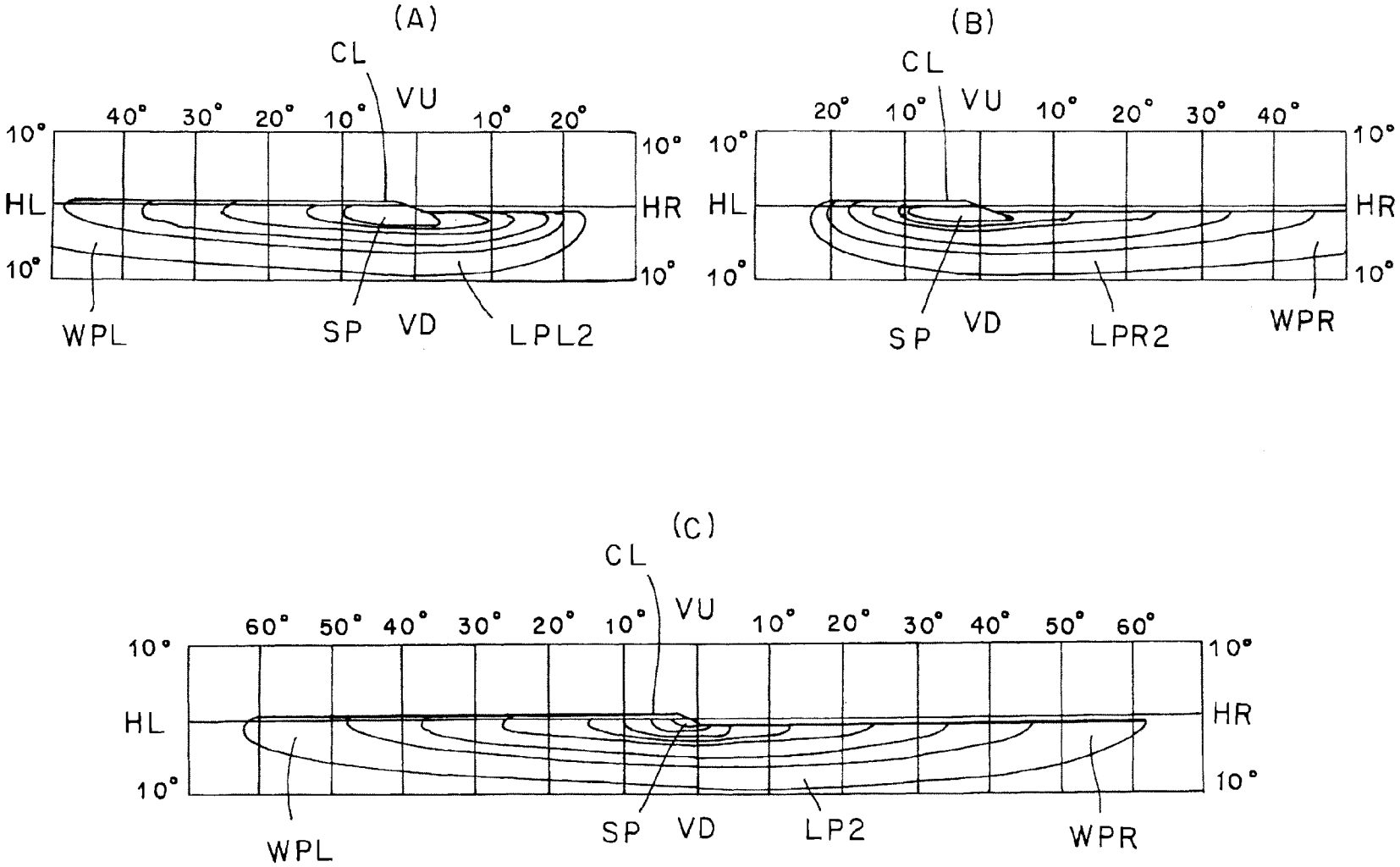
FIG. 15 is an explanatory view showing a light distribution pattern for low beam of a left side vehicle headlamp, a light distribution pattern for low beam of a right side vehicle headlamp, and a light distribution pattern for low beam having been obtained by overlapping both of the left and right vehicle headlamps.

The auxiliary lenses 7L and 7R cause the light beams from the semiconductor-type light sources 2L and 2R to be incident from the incident surfaces 70L and 70R, respectively, and from the emission surfaces 70L and 71R, auxiliary light distribution patterns (refer to reference codes "WPL" and "WPR" in FIG. 15 (A), FIG. 15 (B), and FIG. 15 (C)) are radiated outside of the vehicle with respect to the light distribution patterns for low beams LP1, LPL1, and LPR1, the light distribution patterns having been obtained by means of the vehicle headlamps in the second embodiment described previously.

The auxiliary lenses 7L and 7R may be respectively integrated with the lenses 5L and 5R of the vehicle headlamps in the second embodiment described previously, or alternatively, any other separate lenses may be respectively coupled to the lenses 5L and 5R of the vehicle headlamps in the second embodiment described previously. In addition, the auxiliary lenses 7L and 7R may be respectively provided at their appropriate vehicle outside end parts of the lenses 3L and 3R of the vehicle headlamps 1L and 1R in the first embodiment described previously.

The vehicle headlamps in the third embodiment are respectively made of the constituent elements described above, thus making it possible to achieve functions and advantageous effects that are substantially similar to those of the vehicle headlamps 1L and 1R in the first embodiment described previously and the vehicle headlamps in the second embodiment described previously.

In particular, according to the vehicle headlamp in the third embodiment, both of the left and right end parts of the light distribution patterns for low beams LP1, LPL1, and LPR1, the light distribution patterns having been obtained by means of the vehicle headlamps in the second embodiment described previously, can be further increased in width to the outside of both of the left and right by means of the auxiliary lenses 7L and 7R, and a light distribution pattern having a further ideal cutoff line can be obtained.

Moreover, according to the vehicle headlamps in the third embodiment, a respective one of the vehicle outside end parts of the lenses 5L and 5R of the vehicle headlamps in the second embodiment described previously is formed in a shape going around a given region from the front side to the rear side, by means of the auxiliary lenses 7L and 7R. As a result, when the lenses 7L and 7R of the left and right vehicle headlamps that are mounted on the vehicle are visually seen from a front side of the vehicle, these lenses each are further transversely symmetrical to the center of the vehicle; and therefore, an appearance of an external view is further improved without feeling a further unnatural sense of the external view.

(Description of Fourth Embodiment)

Figure 14:
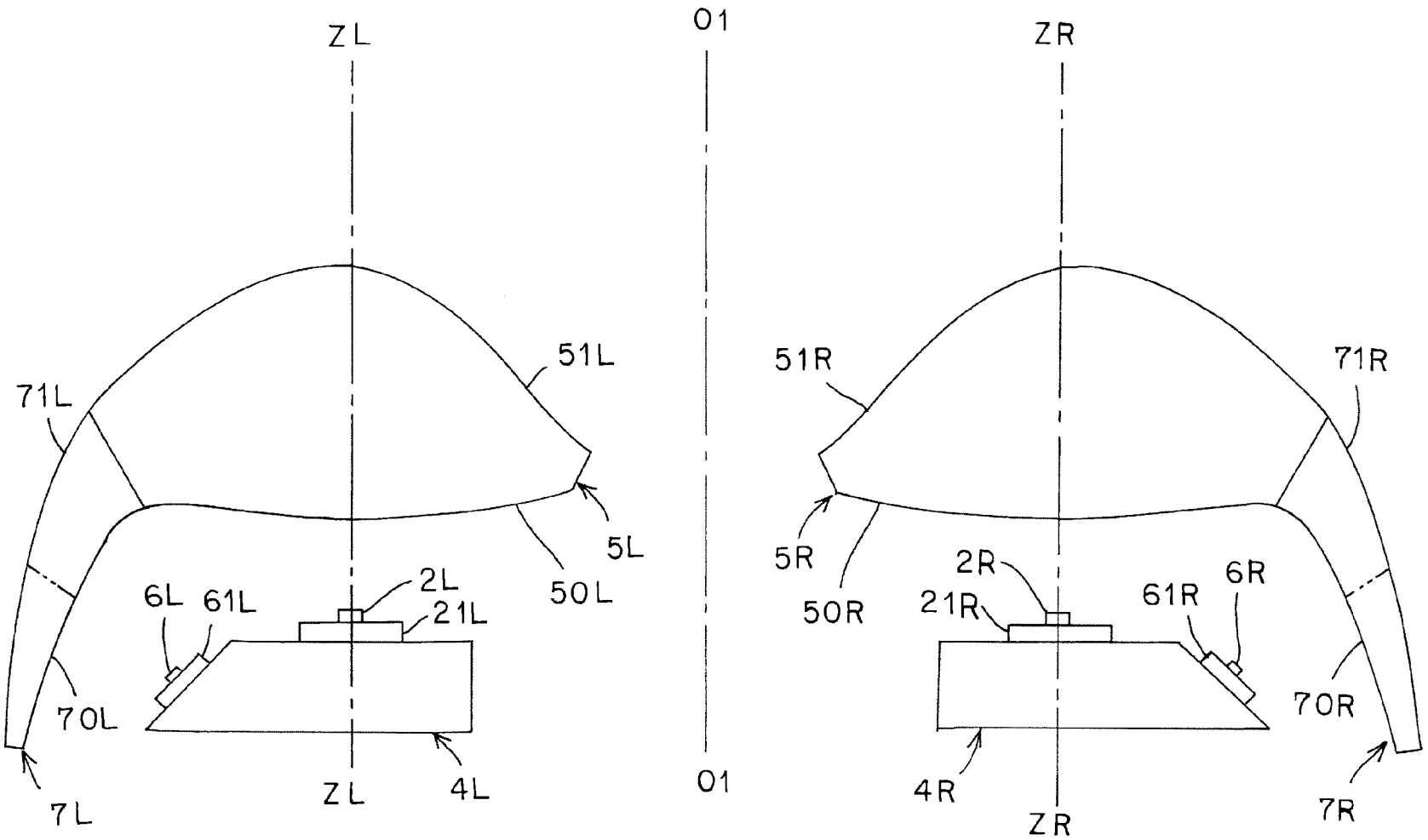
FIG. 14 is an explanatory plan view showing a respective one of the left and right lenses showing a vehicle headlamp according to a fourth embodiment of the present invention.

FIG. 14 and FIG. 15 shows a vehicle headlamps according to a fourth embodiment of the present invention. Hereinafter, the vehicle headlamps in the fourth embodiment will be described. In the figures, like constituent elements shown in FIG. 1 to FIG. 13 are designated by like reference numerals.

The vehicle headlamps in the fourth embodiment comprises auxiliary semiconductor-type light sources 6L and 6R and auxiliary lenses 7L and 7R.

The auxiliary semiconductor-type light sources 6L and 6R are respectively mounted at sites outside of a vehicle of the heat sink members 4L and 4R via mount members 61L and 61R so as to be opposed to the auxiliary lenses 7L and 7R.

The auxiliary lenses 7L and 7R are respectively provided at their appropriate vehicle outside end parts of the lenses 5L and 5R of the vehicle headlamps in the second embodiment described previously. The auxiliary lenses 7L and 7R that are respectively provided at their appropriate vehicle outside end parts of the lenses 5L and 5R of the vehicle headlamps in the second embodiment described previously is formed in a shape going around a given region from a front side to a rear side. In other words, the auxiliary lenses 7L and 7R are respectively provided in the shape going around the given region from the front side to the rear side from their appropriate vehicle outside end parts of the lenses 5L and 5R of the vehicle headlamps in the second embodiment described previously. The auxiliary lenses 7L and 7R in the fourth embodiment are respectively provided to further extend to the outside of the vehicle than the auxiliary lenses 7L and 7R in the third embodiment described previously (portions indicated by the double-dotted chain line in FIG. 14).

Incident surfaces 70L and 70R of the auxiliary lenses 7L and 7R are respectively formed in a shape going around a given region from a front side to a rear side so as to be continuous from their appropriate vehicle outside end parts of the incident surfaces 50L and 50R of the lenses 5L and 5R of the vehicle headlamps in the second embodiment described previously. The incident surfaces 70L and 70R of the auxiliary lenses 7L and 7R each have a turning point which may cause a change in a curvature direction of the incident surfaces 50L and 50R of the lenses 5L and 5R of the vehicle headlamps in the second embodiment described previously. In other words, the incident surfaces 50L, 50R, 70L, and 70R of the lenses 5L, 5R, 7L, and 7R each are formed in an S shape. The emission surfaces 71L and 71R of the auxiliary lenses 7L and 7R respectively faithfully follow the shape formed by the incident surfaces 70L and 70R going around the given region, and these emission surfaces are respectively formed in the shape going around the given region from the front side to the rear side so as to be continuous from the end parts outside of the emission surfaces 51L and 51R of the lenses 5L and 5R of the vehicle headlamps in the second embodiment described previously.

The auxiliary lenses 7L and 7R cause the light beams from the semiconductor-type light sources 2L and 2R to be incident from the incident surfaces 70L and 70R, respectively, and from the emission surfaces 70L and 71R, auxiliary light distribution patterns (refer to reference codes "WPL" and "WPR" in FIG. 15 (A), FIG. 15 (B), and FIG. 15 (C)) are radiated outside of the vehicle with respect to the light distribution patterns for low beams LP1, LPL1, and LPR1, the light distribution patterns having been obtained by means of the vehicle headlamps in the second embodiment described previously.

The auxiliary lenses 7L and 7R may be respectively integrated with the lenses 5L and 5R of the vehicle headlamps in the second embodiment described previously, or alternatively, any other separate lenses may be respectively coupled to the lenses 5L and 5R of the vehicle headlamps in the second embodiment described previously. In addition, the auxiliary lenses 7L and 7R may be respectively provided at their appropriate vehicle outside end parts of the lenses 3L and 3R of the vehicle headlamps 1L and 1R in the first embodiment described previously.

The vehicle headlamps in the fourth embodiment are respectively made of the constituent elements as described above, thus making it possible to achieve functions and advantageous effects that are substantially similar to those of the vehicle headlamps 1L and 1R in the first embodiment described previously and the vehicle headlamps in the second and third embodiments described previously.

In particular, according to the vehicle headlamps in the fourth embodiment, both of the left and right end parts of the light distribution patterns for low beams LP1, LPL1, and LPR1, the light distribution patterns having been obtained by means of the vehicle headlamps in the second embodiment described previously, can be further increased in width to the outside of both of the left and right by means of the auxiliary semiconductor-type light sources 6L and 6R and the auxiliary lenses 7L and 7R, respectively, and as shown in FIG. 15 (A), FIG. 15 (B), and FIG. 15 (C), light distribution patterns LP2, LPL2, LPR2, WPL, and WPR, at least one of which has a further ideal cutoff line CL, can be obtained.

Moreover, according to the vehicle headlamps in the fourth embodiment, a respective one of their appropriate vehicle outside end parts of the lenses 5L and 5R of the vehicle headlamps in the second embodiment described previously is formed in a shape going around a given region from the front side to the rear side, by means of a respective one of the auxiliary lenses 7L and 7R. As a result, when the lenses 7L and 7R of the left and right vehicle headlamps that are mounted on the vehicle are visually seen from a front side of the vehicle, these lenses each are further transversely symmetrical to the center of the vehicle; and therefore, an appearance of an external view is further improved without feeling a further unnatural sense of the external view.

(Description of Examples Other than First, Second, Third, and Fourth Embodiments)

The first, second, third, and fourth embodiments have described vehicle headlamps 1L and 1R in a case where a vehicle C cruises on a left side. However, the present invention can be applied to vehicle headlamps in a case where the vehicle C cruises on a right side.

In the first, second, third, and fourth embodiments, the incident surfaces 30L and 30R of the lenses 3L and 3R each are formed in a convex shape that gently protrudes to the side of a respective one of the semiconductor-type light sources 2L and 2R. However, in the present invention, the incident surfaces 30L and 30R of the lenses 3L and 3R each may be formed in a planer shape, or alternatively, these incident surfaces each may be formed in a concave shape that is gently recessed on an opposite side to that of a respective one of the semiconductor-type light sources 2L and 2R.

What is claimed is:

1. A vehicle headlamp comprising:

a semiconductor-type light source; and a lens adapted to forwardly radiate light from the semiconductor-type light source as a light distribution pattern having a cutoff line, wherein the lens is made of an incident surface in which the light from the semiconductor-type light source is incident into the lens and an emission surface from which the light that is incident into the lens is emitted, the incident surface of the lens is made of a composite curved surface that is transversely symmetrical to an optical axis of lens, the emission surface of the lens is formed in a convex shape that gently protrudes to an opposite side to a side of the semiconductor-type light source, the emission surface being made of a free curved surface, and on the emission surface of the lens, a peak portion that forms a spot portion of the light distribution pattern is provided in a given location that is close to a cruising lane side with respect to the optical axis of the lens.

2. The vehicle headlamp according to claim 1, wherein the incident surface of the lens is formed in a convex shape that gently protrudes to the semiconductor-type light source side.

3. The vehicle headlamp according to claim 1, wherein on the emission surface of the lens, a gradient from the optical axis of the lens to an outside of a vehicle is gentler than a gradient from the optical axis of the lens to an inside of the vehicle.

4. The vehicle headlamp according to claim 1, wherein in a shape of a planar view of the lens, a thickness from the optical axis of the lens to the outside of the vehicle is larger than a thickness from the optical axis of the lens to the inside of the vehicle.

5. The vehicle headlamp according to claim 1, wherein a vehicle outside end part of the lens is formed in a shape going around a given region from a front side to a rear side.

6. The vehicle headlamp according to claim 1, comprising: an auxiliary semiconductor-type light source; and an auxiliary lens adapted to radiate light from the auxiliary semiconductor-type light source as an auxiliary light distribution pattern to the outside of the vehicle with respect to the light distribution pattern, wherein the auxiliary lens is provided at a vehicle outside end part of the lens.

* * * * *